US006105928A

United States Patent [19]

Ise et al.

[11] Patent Number: 6,105,928

[45] Date of Patent: Aug. 22, 2000

[54] PRESSURE ADJUSTING VALVE FOR VARIABLE CAPACITY COMPRESSORS

[75] Inventors: Sadatake Ise; Akinori Fujisawa; Masaki Tomaru, all of Tokyo, Japan

[73] Assignee: Fujikoki Corporation, Tokyo, Japan

[21] Appl. No.: 09/310,752

[22] Filed: May 13, 1999

[30] Foreign Application Priority Data

May 15, 1998 [JP] Japan ..... 10-133816

[51] Int. Cl.[7] ..... F16K 31/145; F16K 47/00; F04B 1/26

[52] U.S. Cl. ..... 251/61.2; 251/118; 417/222.2

[58] Field of Search ..... 251/61.2, 118; 417/222.2

[56] References Cited

U.S. PATENT DOCUMENTS 4,723,891 2/1988 Takenaka et al. ..... 417/222.2

4,729,718 3/1988 Ohta et al. ..... 417/222.2

5,018,703 5/1991 Goode ..... 251/118

5,154,204 10/1992 Hatzikazakis ..... 251/61.2

*Primary Examiner*—Kevin Shaver

*Assistant Examiner*—David A. Bonderer

*Attorney, Agent, or Firm*—Baker Botts L.L.P.

[57] ABSTRACT

A pressure adjusting valve for a variable capacity compressor comprising a main body portion provided with a lower lid, a spring case provided with an upper lid, and a diaphragm held between the upper lid and the lower lid. The upper lid and lower lid are hermetically connected with each other through caulking and soldering. Alternatively, the upper lid and the lower lid are hermetically connected with each other by means of an electron beam welding.

10 Claims, 8 Drawing Sheets

PRESSURE ADJUSTING VALVE FOR VARIABLE CAPACITY COMPRESSORS

BACKGROUND OF THE INVENTION

The present invention relates to a pressure adjusting valve, and in particular to a pressure adjusting valve for a variable capacity compressor to be mounted on air conditioners for vehicles.

Generally, a vapor compression type cooling system is extensively employed as a cooling system for a vehicle. According to this cooling system, a coolant is turned into a gas of high temperature and high pressure as the coolant is adiabatically compressed in a compressor, and this resultant gas is then liquefied as the heat thereof is released therefrom in a condenser. Thereafter, the resultant liquid is adiabatically expanded by means of an expansion valve thereby causing the liquid to absorb an external heat in an evaporator, thus causing the liquid to turn into gas while concurrently bringing about a cooling effect of air, the resultant gasified coolant being returned again to the compressor. Namely, this cooling system is a kind of refrigerating cycle which takes advantage of the heat of evaporation. FIG. 7 illustrates a refrigerating apparatus of the aforementioned vapor compression type cooling system, which is constituted by a compressor A, a condenser B, an expansion valve C and an evaporator D.

The compressor A shown in FIG. 7 is a reciprocating type compressor utilizing a wobble plate, and is consisted of a driving shaft 81, a wobble plate 82, connecting rods 83, pistons 84 and cylinders 85. The driving shaft 81 which is rotatably arranged inside a crankcase 80 is designed to be driven by an engine (not shown) through a pulley 86 and a belt 87 which are attached to one end of the driving shaft 81. The wobble plate 82 mounted on the driving shaft 81 is rotated following the rotation of driving shaft 81. The wobble plate 82 is spherically coupled, through an annular groove 88 formed in the wobble plate 82, with the connecting rod 83. On the other hand, the connecting rod 83 is coupled via a socket 89 with the piston 84, so that the connecting rod 83 and the piston 84 are permitted to be reciprocatively moved in conformity with an inclined state of the rotating wobble plate 82. Each cylinder 85 of the compressor A is provided with a suction chamber "s" and a discharging chamber "d" wherein these plural suction chambers "s" are mutually communicated with each other, and likewise, these plural discharging chambers "d" are mutually communicated with each other. The suction chamber "s" is provided with a valve which is designed to be opened in the suction stroke of the piston 84, while the discharging chamber "d" is provided with a valve which is designed to be opened in the discharge stroke of the piston 84. Further, the discharging chamber "d" is communicated with the condenser B, while the evaporator D is communicated with the suction chamber "s", so that a coolant discharged from the discharging chamber "d" is permitted pass through the condenser B, the expansion valve C and the evaporator D thereby bringing about a predetermined cooling effect, after which the coolant is returned to the suction chamber "s".

A pressure adjusting valve 1' is built in a suitable portion of the compressor A. This pressure adjusting valve 1' is designed to detect a pressure of coolant to be sucked in the cylinder 85 thereby altering the capacity of the coolant to be flown into the crankcase 80, thereby controlling the pressure inside the compressor A and hence to maintain the pressure inside the evaporator D. The suction chamber "s" of the cylinder 85 is communicated with a pressure chamber 21' of the pressure adjusting valve 1', the interior of the crankcase 80 is communicated with an intermediate chamber 22' of the pressure adjusting valve 1', and the discharging chamber "d" of the cylinder 85 is communicated with a valve chamber 23' of the pressure adjusting valve 1'. By the way, a escape passage for relieving the pressure inside the crankcase 80 is provided between the interior of the crankcase 80 and the suction chamber "s".

As shown in FIG. 8, this pressure adjusting valve 1' is constituted by a pressure responding motive portion 10' and a main body portion 20'. The pressure responding motive portion 10' attached to one end of the main body portion 20' comprises an upper lid 12' retaining a diaphragm 11' which is sandwiched between the upper lid 12' and a lower lid 22' integrally attached to the main body portion 20', and a case 13' which is integrally mounted through welding on the upper lid 12'. Inside this case 13', there are disposed an adjusting screw 17' screwed into the case 13', a spring shoe 15' contacted with an upper reinforcing plate 14' for the diaphragm 11', and a pressure-setting spring 16' interposed between the adjusting screw 17' and the spring shoe 15' and urging a ball valve 25' in the direction to open the passageway.

The main body portion 20' comprises an operating rod 24' contacted with a lower reinforcing plate 32' for the diaphragm 11', and a slide hole 28' formed passing through the main body portion 20'. A pressure chamber 21' is formed at a portion of the main body portion 20' where one end of the operating rod 24' and the lower reinforcing plate 32' are located, and is provided with an inlet port 29' for introducing a suction pressure (a suction pressure: Ps) of the cylinder 85. The other end of the operating rod 24' is extended to the valve chamber 23' in which there are disposed a ball valve 25' contacted with the other end of the operating rod 24', a valve seat 27', and a ball valve-retaining spring 26' interposed between a valve guard 33' contacted with the ball valve 25' and a spring shoe 46' built in the valve chamber 23', the ball valve-retaining spring 26' being set so as to urge the ball valve 25' in the direction to close the passageway.

A feeding port 30' for feeding a pressure (a pressure inside the crankcase: Pc) inside the compressor A is formed over the valve seat 27', and an inlet port 31' for introducing a discharge pressure (a discharge pressure: Pd) of the cylinder 85 is formed below the valve seat 27'. The pressure from the evaporator D is introduced into the suction chamber "s" and the pressure chamber 21', and when the suction pressure Ps is decreased, i.e. when the pressure inside the pressure chamber 21' is decreased, the urging force of the pressure-setting spring 16' becomes larger than the combined force of the diaphragm 11' and the ball valve-retaining spring 26', thereby causing the diaphragm 11' to move in the direction to push down the operating rod 24'. As a result, the ball valve 25' is opened, and the discharge pressure Pd is introduced via the pressure adjusting valve 1' into the interior of the crankcase 80, thereby increasing the pressure Pc inside the crankcase 80 and concurrently increasing the angle θ between the driving shaft 81 and the wobble plate 82, thus minimizing the magnitude of stroke of the piston 84.

On the other hand, when the pressure inside the pressure chamber 21' is increased, the urging force of the pressure-setting spring 16' becomes smaller than the combined force of the diaphragm 11' and the ball valve-retaining spring 26', thereby causing the diaphragm 11' to move in the direction to push up the operating rod 24'. As a result, the ball valve 25' is closed, thereby decreasing the angle θ between the driving shaft 81 and the wobble plate 82, thus enlarging the magnitude of stroke of the piston 84 (FIG. 7). Namely, the pressure adjusting valve 1' is designed to detect the suction pressure Ps and to control the pressure Pc inside the crankcase thereby to alter the magnitude of stroke of the piston 84, thus maintaining the pressure of the evaporator D.

It is desired that a vehicle is capable of suitably coping with any changes in operating environment, in particular, changes of environment due to atmospheric pressure and temperature. For example, the pressure responding motive portion 10' should be free from any influence by environmental changes as a vehicle travels on a road including a low altitude portion as well as a high altitude portion. With a view to cope with this problem, a pressure adjusting valve is proposed in Japanese Patent Unexamined Publication (Kokai) H5-39876 wherein the pressure-setting spring 16' is adjusted by means of a screw 17', and after a vacuum cap 18' is welded to the spring case 13', the pressure responding motive portion 10' is exhausted to a predetermined gas pressure or filled with an inert gas using a capillary tube (not shown) thereby preventing the pressure responding motive portion 10' from being influenced by changes in pressure and temperature (FIG. 8).

By the way, according to the aforementioned prior art, the diaphragm is held between the upper lid and the lower lid, and after the fringe portion of the diaphragm is welded, the spring case and capillary tube are secured to the upper lid by means of welding. Thereafter, the interior of the pressure responding motive portion is adjusted to a predetermined gas pressure, followed by the sealing of the capillary tube. However, the aforementioned prior art is accompanied with the problems that the reliability in air-tightness of the pressure responding motive portion may not be sufficient, since the air-tightness is effected only by the sealing of the capillary tube, and that since the manufacture of this pressure adjusting valve involves a large number of working steps and requires a large number of parts, the cost for manufacturing this pressure adjusting valve may be inevitably increased.

BRIEF SUMMARY OF THE INVENTION

The present invention has been made under the circumstances mentioned above, and therefore an object of the present invention is to provide a pressure adjusting valve, which is capable of improving the air-tightness of the pressure responding motive portion and the performance of the main body portion, and at the same time, capable of minimizing the manufacturing cost thereof by reducing the working process, assembling process and parts to be employed.

The aforementioned object can be achieved by the present invention by providing a pressure adjusting valve for a variable capacity compressor comprising a main body portion provided with a lower lid, a spring case provided with an upper lid, and a diaphragm held between said upper lid and said lower lid; wherein said lower lid is provided at an outer circumference portion thereof with a cylindrical fitting portion and an annular projection, and said upper lid and said lower lid are hermetically connected with each other in such a manner that said upper lid is fitted in said cylindrical fitting portion, said annular projection is caulked innerward leaning against said upper lid, and a space between said annular projection and said upper lid is soldered.

As an another aspect of the present invention, there is provided a pressure adjusting valve for a variable capacity compressor comprising a main body portion provided with a lower lid, a spring case provided with an upper lid, and a diaphragm held between said upper lid and said lower lid; wherein said upper lid and said lower lid are hermetically connected with each other by means of an electron beam welding which is effected at annular outer circumferential portions of these upper and lower lids.

According to a preferable embodiment of the present invention, the main body portion is provided with a valve chamber having a valve body arranged therein, and a conical coil spring urging said valve body in a direction to close a passageway, wherein said conical coil spring is arranged such that a smaller diametral portion thereof is directly contacted with said valve body thereby pushingly supporting said valve body, and a larger diametral portion thereof is engaged with an annular step portion formed in said valve chamber.

According to another preferable embodiment of the present invention, the main body portion is provided with a valve chamber, and a valve body guide arranged in said valve chamber, wherein said valve body guide is provided with an outer circumferential side wall contacting with said valve chamber and an inner circumferential side wall with which said valve body is contacted, said inner circumferential side wall being provided with a large number of grooves extending in the direction of flow. Further, the main body portion is provided with an operating rod for actuating the valve body in an interlocking manner in relative to the movement of the diaphragm, and with a slide hole for allowing the operating rod to slidably move therein, wherein the operating rod and the slide hole are designed to be partially contacted with each other, thus forming a partial sliding surface therebetween.

Furthermore, the main body portion is provided on the outer circumferential wall thereof with a plurality of annular stepped portions which are diametrally reduced stepwise and are respectively fitted with an annular sealing member, the annular stepped portions being adapted to be engaged with a plurality of annular stepped portions which are diametrally reduced and formed on the inner wall of the engaging hole provided in the variable capacity compressor.

As described above, since the pressure controlling valve of the present invention is constructed such that the diaphragm is held between the upper lid and the lower lid, that the fitting portion, the annular projection and the diaphragm are simultaneously caulked together, and that a space between the annular projection and the upper lid is hermetically sealed by means of soldering, the air-tightness of the pressure responding motive portion can be improved.

Further, if an electron beam welding is employed, the pressure responding motive portion can be always prevented from being influenced by any changes in air atmosphere and temperature, so that works such as the exhaustion or gas filling by making use of a capillary tube, the sealing of the capillary tube, etc. can be dispensed with, thus facilitating the manufacture and adjustment of the pressure adjusting valve as compared with the conventional pressure adjusting valve.

Furthermore, since the valve is directly supported on a smaller diametral portion of the conical coil spring, any special supporting member such as a valve guard for supporting the valve is no more required. Additionally, since the main body portion of the pressure adjusting valve is provided on the outer circumferential wall thereof with a plurality of annular stepped portions which are diametrally reduced stepwise and are respectively fitted with an annular sealing member for engagement, the cost for manufacturing the pressure adjusting valve can be reduced.

DETAILED DESCRIPTION OF THE INVENTION

Figure 1:
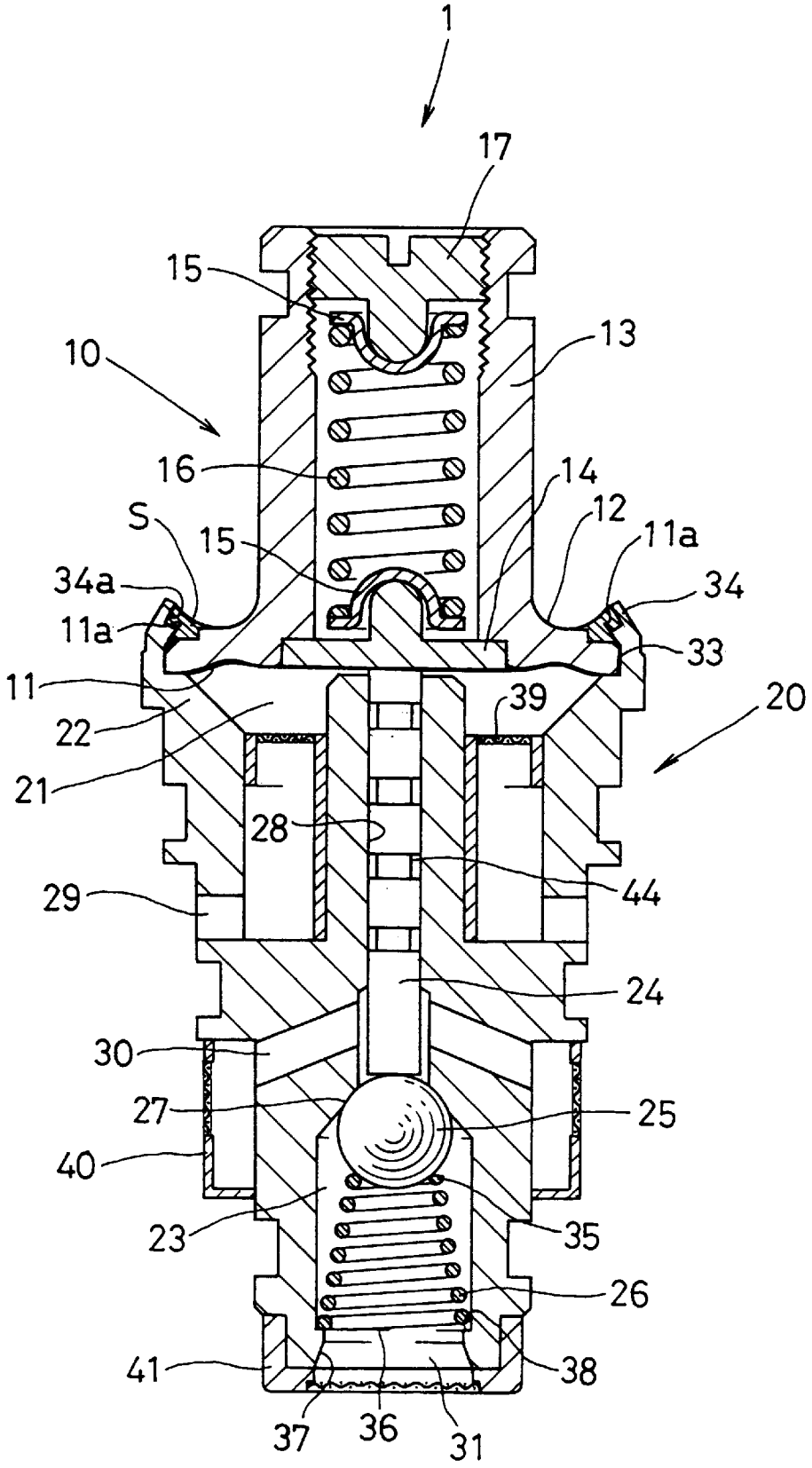
FIG. 1 is a longitudinal sectional view illustrating a pressure adjusting valve according to one embodiment of the present invention.

The present invention will be further explained with reference to the drawings depicting embodiments of the present invention. In these embodiments, the members which function in the same manner as those of the prior art are indicated by the same reference numerals.

FIG. 1 illustrates one embodiment of the present invention, wherein this pressure adjusting valve 1 is constituted by a pressure responding motive portion 10 and a main body portion 20. The pressure responding motive portion 10 attached to the upper end of the main body portion 20 comprises an upper lid (made of brass) 12 retaining a diaphragm (made of beryllium copper) 11 which is sandwiched between the upper lid 12 and a lower lid 22 integrally attached to the main body portion (made of brass) 20, and a case 13 which is integrally mounted on the upper lid 12. Inside this case 13, there are disposed an adjusting screw 17 screwed into the case 13, a pair of spring shoes 15 contacted with the adjusting screw 17 and with an upper reinforcing plate 14 for the diaphragm 11, and a pressure-setting spring 16 interposed between these spring shoes 15, and urging a ball valve 25 in the direction to open the passageway.

The main body portion 20 comprises an operating rod 24 contacted with the diaphragm 11, and a slide hole 28 formed passing through the main body portion 20. A pressure chamber 21 is formed at a portion of the main body portion 20 where one end of the operating rod 24 is located, and is provided with an inlet port 29 for introducing a suction pressure. The other end of the operating rod 24 is extended to the valve chamber 23 in which a ball valve 25 contacted with the other end of the operating rod 24, a valve seat 27 provided with a communicating hole for valve chamber 23, and a ball valve-retaining spring 26 being set so as to urge the ball valve 25 in the direction to close the passageway are provided.

A feeding port 30 for feeding a pressure inside the crankcase is formed over the valve chamber 23, and an inlet port 31 for introducing a discharge pressure is formed below the valve chamber 23. The pressure adjusting valve 1 is designed to detect the suction pressure Ps and to control the pressure Pc inside the crankcase thereby to alter the magnitude of stroke of the piston 84, thus maintaining the pressure of the evaporator D.

Next, the connection between the pressure responding motive portion 10 and the main body portion 20 in the pressure controlling valve 1 will be explained. Namely, this connection is effected through a combination between the upper lid 12 of the pressure responding motive portion 10 and the lower lid 22 of the main body portion 20.

The lower lid 22 is provided with a cylindrical fitting portion 33 and an annular projection 34 for caulking. This fitting portion 33 is cylindrical in configuration being formed coaxial with the longitudinal axis of the slide hole 28 of the main body portion. The upper lid 12 having a cylindrical configuration is coaxially fitted in the inner circumferential wall portion of the lower lid 22. In the same manner as that of the fitting portion 33, the annular projection 34 is cylindrical in configuration and formed coaxial with the longitudinal axis of the slide hole 28 of the main body portion. This annular projection 34 is made thinner in the radial direction than the fitting portion 33.

The diaphragm 11 is held between the outer circumferential wall of the upper lid 12 and the inner circumferential wall of the lower lid 22. The fitting portion 33, the annular projection 34 and the diaphragm 11 are integrally bent innerward or in the direction directed from the outer circumferential wall of the lower lid 22 to the inner circumferential wall thereof, thereby coupling the diaphragm 11 and the fitting portion 33 with the upper lid 12 in conformity with the shape of the upper lid 12.

This caulking is performed in such a manner that a space S is formed between the annular projection 34 and the upper lid 12. Then, a solder is filled in this space S thereby fill the space S with the solder, thus more completely sealing this caulked portion. This annular projection 34 is extended longer than the outermost brim portion 11*a* of the diaphragm after the aforementioned caulking, and provided on the inner circumferential wall thereof with a stepped portion 34*a* which is prevented from contacting with the outermost brim portion 11*a* of the diaphragm. The reason for the provision of this annular projection 34 is that if the outermost brim portion 11*a* is extended longer than the annular projection 34, or if the outermost brim portion 11*a* is contacted with the annular projection 34, a pressure leakage may be generated after the soldering. By the way, the aforementioned annular projection 34 may be formed on the upper lid 12, and the upper lid 12 and the diaphragm 11 may be integrally caulked against the lower lid 22, thereby obtaining a hermetically sealed pressure adjusting valve.

By the way, brass is employed as a materiel for the upper lid 12 and for the lower lid 22 in the above pressure adjusting valve 1. However, if copper is employed for these lids 12 and 22, the coupling of these lids 12 and 22 can be performed by means of an electron beam welding without necessitating the employment of a solder.

The ball valve-retaining spring 26 which is set so as to urge the ball valve 25 in the direction to close the passageway is formed of a conical coil spring having a small diametral side 35 and a large diametral side 36. The end face of the small diametral side 35 is flattened by means of polishing, while the terminal end portion at the large diametral side 36 of the spring is directed innerward in the radial direction thereof. The ball valve 25 is directly supported by the small diametral side 35 of the ball valve-retaining spring 26. The ball valve 25 may be integrally connected with the ball valve-retaining spring 26 by spot-welding the contacting portion between the ball valve 25 and the small diametral side 35 of the ball valve-retaining spring 26. The valve chamber 23 is provided with a tapered portion 37 formed in the vicinity of the discharge pressure-introducing port 31 and tapering in the direction directed from the outside of the discharge pressure-introducing port 31 to the inner wall of the valve chamber 23, and a stepped portion 38 formed between the terminal portion of the tapered portion 37 and the inner wall of the valve chamber 23.

The ball valve-retaining spring 26 can be set in place as follows. Namely, after the ball valve 25 is introduced into the valve chamber 23, the ball valve-retaining spring 26 is introduced into the valve chamber 23 while forcing the large diametral side 36 thereof to shrink in radial direction along the tapered portion 37. The ball valve-retaining spring 26 introduced in this manner into the valve chamber 23 is then fixedly mounted on the stepped portion 38 by taking advantage of the restoring force of the spring. By the way, the terminal end portion of the large diametral side 36 of the spring, which is directed innerward in the radial direction, is prevented from being contacted with the tapered portion 37 and makes it easy to mount the ball valve-retaining spring 26 in the valve chamber 23. After the ball valve 25 and the ball valve-retaining spring 26 are set in place inside the valve chamber 23, the ball valve 25 is punched using a jig (not shown) which can be introduced through the discharge pressure-introducing port 31, thereby causing the shape of the ball valve 25 to conform with the shape of the valve seat 27, thus minimizing the generation of valve leakage.

The outer circumferential wall of a portion of the operating rod 24 which is located to face the slide hole portion of the main body portion is provided with a large number of annual grooves 44, thus providing the operating rod 24 with portions which are contacted with the slide hole 28 and also with portions which are not contacted with the slide hole 28. As a result, a labyrinth effect can be generated in a fluid flowing through a clearance between the operating rod 24 and the slide hole 28 thereby to minimize a clearance leakage between the suction pressure inlet port 29 and the feeding port 30. Further, in order to prevent any impurities which may be mingled into a coolant during the circulation thereof from being introduced into the pressure adjusting valve 1, a strainer 39 is attached to the inner wall of suction pressure inlet port 29 by means of press-fitting or screwing, and additionally, strainers 40 and 41 are also attached to the outer walls of feeding port 30 and of the discharge pressure-introducing port 31 by means of press-fitting.

The pressure-setting spring 16 mounted in the pressure responding motive portion 10 is constituted by a cylindrical coil spring, both end faces of which are flattened by means of polishing. These end faces are supported, via a convex spring shoes 15 being faced to each other and disposed coaxial with the spring, by a convex adjusting screw 17 disposed at the top of the spring 16 and facing downward and by the upper reinforcing plate 14 disposed at the bottom of the spring 16. As a result, the axial alignment of the pressure-setting spring 16 can be automatically effected, thereby making it possible to render the force of the spring 16 to be perpendicularly acted on the ball valve 25 through the operating rod 24, and to stabilize the movement of the operating rod 24 against changes in pressure of the pressure chamber 21.

Figure 2:
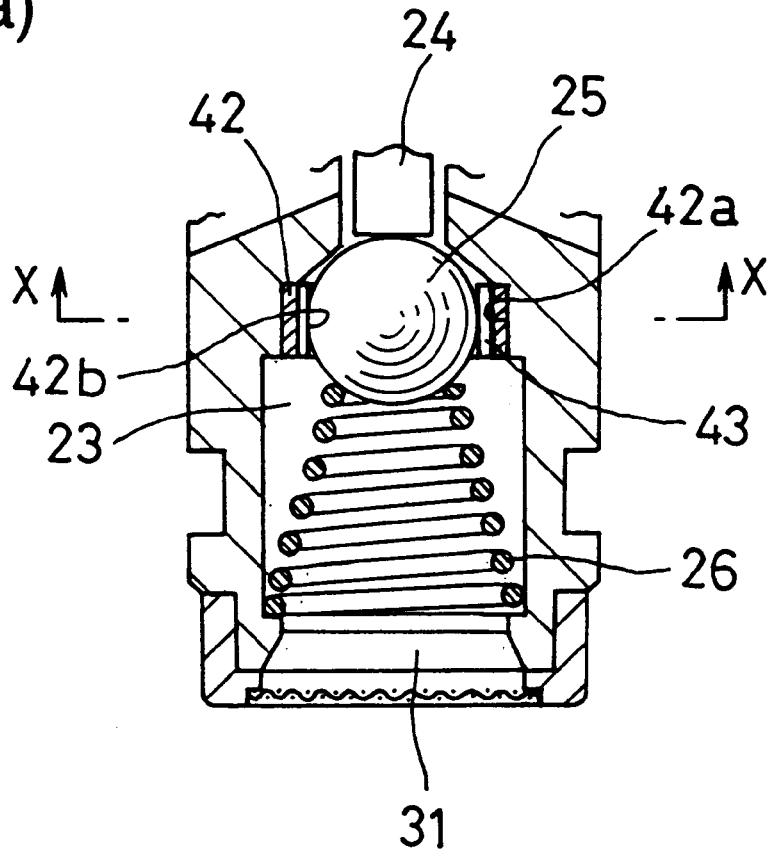
FIG. 2 is a cross-sectional view illustrating a pressure adjusting valve, wherein a valve guide is disposed in the valve chamber.
Figure 2:
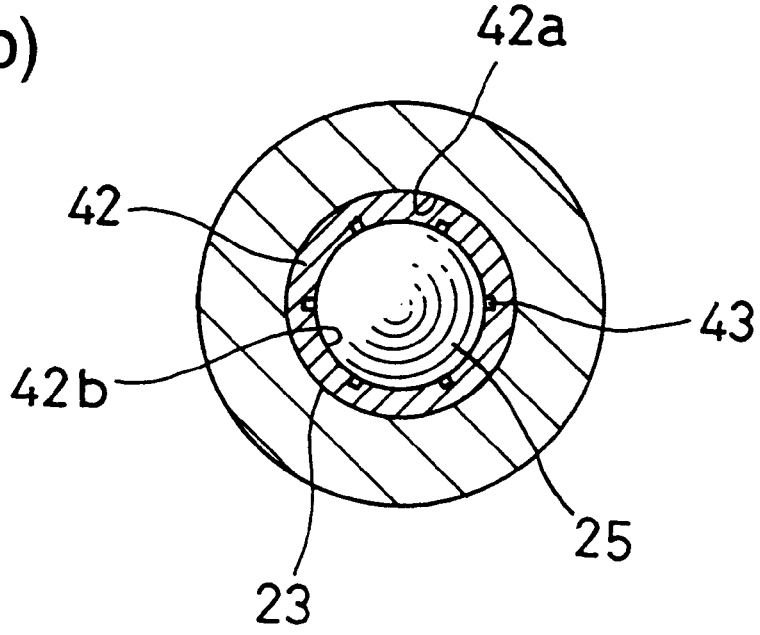

FIGS. 2*a* and 2*b* illustrate an embodiment where a valve guide 42 for guiding the movement of the ball valve 25 is provided in the valve chamber 23 of the pressure adjusting valve 1. As shown in FIG. 2*a*, the valve guide 42 is cylindrical in configuration and the outer circumferential wall 42*a* thereof is contacted with the inner wall of the valve chamber 23, while the inner circumferential wall 42*b* thereof is contacted with the circumferential line of the ball valve 25, thereby to prevent the generation of rocking movement and the accompanying vibration and noise, thus stabilizing the movement of the ball valve 25. FIG. 2*b* is a cross-sectional view taken along the line X—X of FIG. 2*a*, and illustrates that the valve guide 42 is provided with grooves 43 functioning as a fluid passageway. These grooves 43 are formed in the inner circumferential wall of the valve guide 42 and are parallel with the flow line and formed equidistantly as viewed in the circumferential direction. The provision of these grooves 43 is effective in rectifying the liquid flow, in homogenizing the force acting on the ball valve 25, and in further improving the stability in movement of the ball valve 25 By the way, this valve guide 42 may be formed integral with or separate from the valve chamber 23.

Figure 3:
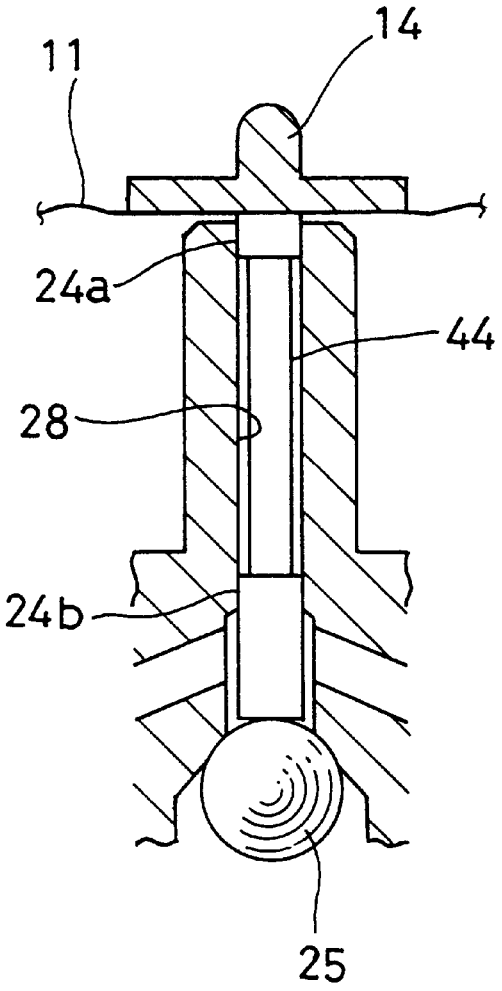
FIG. 3 is a longitudinal sectional view of a pressure adjusting valve, illustrating the sliding surface of main body portion.
Figure 3:
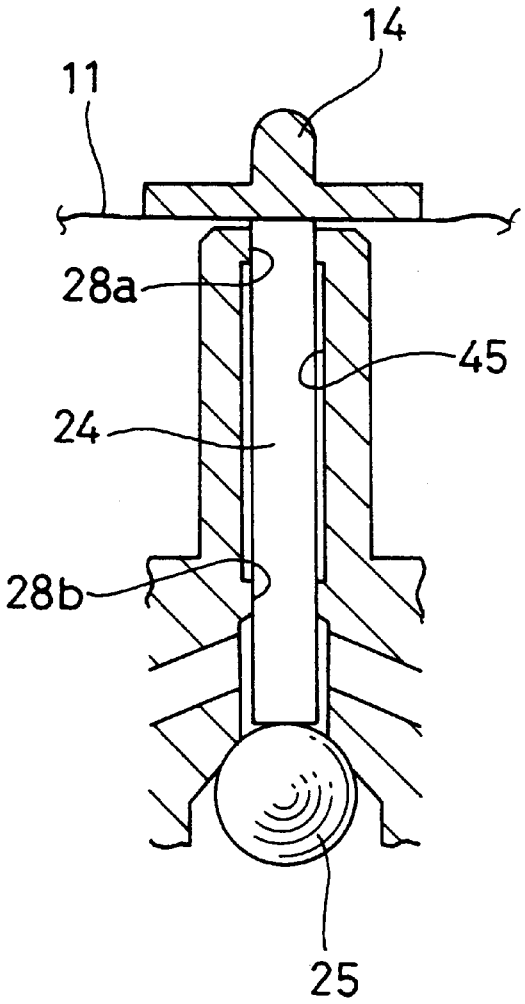

FIG. 3 illustrates the sliding surface between the operating rod 24 and the slide hole 28. This operating rod 24 is permitted to move up and down within the slide hole 28 of the main body portion in conformity with changes in pressure of the pressure chamber 21, thereby opening or closing the ball valve 25. If the contacting area between the operating rod 24 and the slide hole 28 is large in this case, the frictional resistance at the occasion of sliding would be increased. Therefore, either a stepped rod 44 (FIG. 3*a*) where every portions of the operating rod 24 except both end portions 24*a* and 24*b* are made smaller in diameter, or a stepped hole 45 (FIG. 3*b*) where every portions of the slide hole 28 except both end portions 28*a* and 28*b* are made larger in diameter can be employed thereby to minimize the contacting area between the operating rod 24 and the slide hole 28, and hence to minimize the sliding frictional resistance. As a result, the hysteresis of operation characteristics or difference in operation characteristics that may be generated in the reciprocating movement of the ball valve 25 can be reduced.

Figure 4:
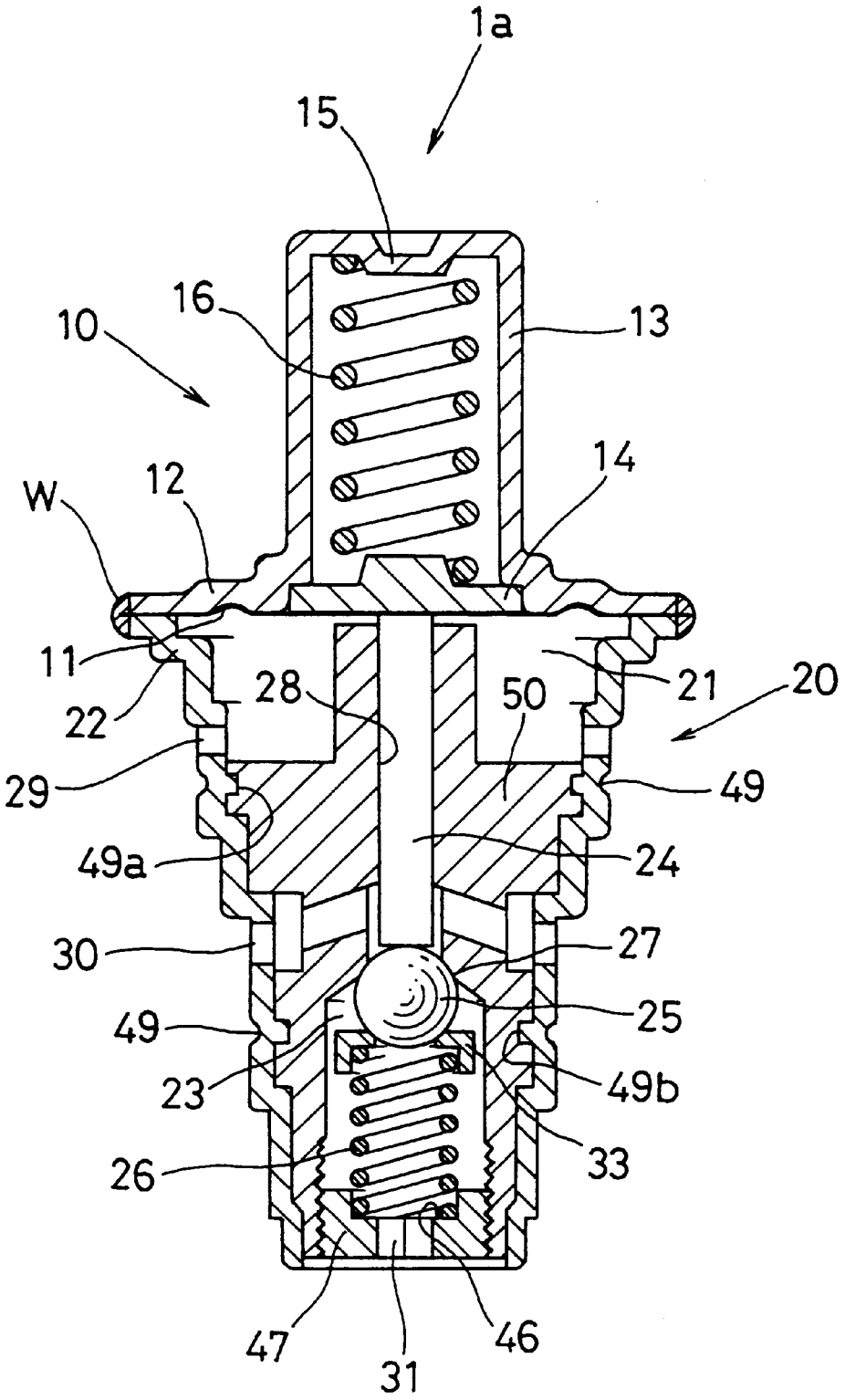
FIG. 4 is a longitudinal sectional view illustrating a pressure adjusting valve according to another embodiment of the present invention.

FIG. 4 illustrates another embodiment of the present invention, wherein this pressure adjusting valve 1*a* is constituted by a pressure responding motive portion 10 and a main body portion 20. The pressure responding motive portion 10 attached to the upper end of the main body portion 20 comprises an upper lid 12 or shell (made of copper) retaining a diaphragm (made of beryllium copper) 11 which is sandwiched between the upper lid 12 and a lower lid 22 or shell (made of copper) integrally attached to the main body portion 20, and a case 13 which is integrally mounted on the upper lid 12 or shell. Inside this case 13, a spring 16 is interposed between the upper end portion 15 of the spring case 13 and an upper reinforcing plate 14 of the diaphragm 11, the spring 16 urging a ball valve 25 in the direction to open the passageway.

The main body portion 20 comprises a lower lid 22 or shell, a main valve body 50 (made of brass), an operating rod 24 contacted with the diaphragm 11, and a slide hole 28 formed passing through the main body portion 20. A pressure chamber 21 is formed at a portion of the main body portion 20 where one end of the operating rod 24 is located, and is provided with an inlet port 29 for introducing a suction pressure. The other end of the operating rod 24 is extended to the valve chamber 23 in which there are disposed a ball valve 25 contacted with the other end of the operating rod 24, a valve seat 27 provided with a communicating hole for valve chamber 23, and a pressure-setting/ball valve-retaining spring 26 being interposed between the valve guard contacting with the ball valve 25 and the adjusting spring stopper 46 screwed into the valve chamber 23, and set so as to urge the ball valve 25 in the direction to close the passageway.

A feeding port 30 for feeding a pressure inside the crankcase is formed over the valve chamber 23, and an inlet port 31 for introducing a discharge pressure is formed below the valve chamber 23. The pressure adjusting valve la is designed to detect the suction pressure Ps and to control the pressure Pc inside the crankcase thereby to alter the magnitude of stroke of the piston 84, thus maintaining the pressure of the evaporator D.

Next, the connection between the pressure responding motive portion 10 and the main body portion 20 in the pressure controlling valve 1*a* will be explained. Namely, this connection is effected through a combination between the upper lid 12 or shell of the pressure responding motive portion 10 and the lower lid 22 or shell of the main body portion 20.

The upper lid 12 and lower lid 22 are both cylindrical in configuration being formed coaxial with the longitudinal axis of the slide hole 28 of the main body portion. These upper and lower lids 12 and 22 are formed by means of press molding. The spring case 13 formed integral with the upper lid 12 or shell is assembled with a spring 16 urging the ball valve 25 in the direction to open the passageway and with an upper reinforcing plate 14. Then, the main valve body 50 provided with the ball valve 25 and the operating rod 24 is fitted in the lower lid 22 or shell, after which the diaphragm 11 is held between the shells, i.e. the upper lid 12 and the lower lid 22. Thereafter, the brim portions W of the diaphragm 11, the upper lid 12 and the lower lid 22 are simultaneously welded by means of electron beam welding (EBW). Since the electron beam welding is performed in vacuum in general, the interior of the spring case 13 becomes vacuum at the moment of finishing the welding. Therefore, the pressure responding motive portion 10 can be always prevented from being influenced by any changes in air atmosphere and temperature. By the way, since the electron beam welding is minimal in welding heat and in strain of the welded portion, the electron beam welding is advantageous in these respects.

Since these shells constituting the upper and lower lids 12 and 22 of the pressure adjusting valve 1*a* according to this embodiment are connected together by making use of the electron beam welding, a material (made of copper) which is different from the material (made of brass) of the main valve body 50 is employed for these shells. The fixing of the shell (the lower lid 22) to the main valve body 50 can be performed by a process wherein the main valve body 50 provided with an annual groove is fitted in the shell at first, and then the outer circumferential wall of the shell is contractingly caulked toward the circumferential groove of the main valve body 50 by making use of a three-piece jig for instance thereby to coupling the shell with the main valve body 50.

If the contracting caulking is performed after fitting the main valve body 50 provided with circumferential grooves 49*a* and 49*b* in the shell as shown in FIG. 4, the air-tightness of intermediate portions among the suction pressure inlet port 29, the feeding port 30 and the discharge pressure-introducing port 31 can be realized. By the way, since a hexagon socket head adjusting screw 47 is screwed into the discharge pressure-introducing port 31 thereby making it possible to secure the flow passageway and to perform a fine adjustment of the setting pressure in this pressure adjusting valve 1*a*, the spring 26 can be functioned as a ball valve-retaining spring and at the same time, as a pressure adjusting spring.

Figure 7:
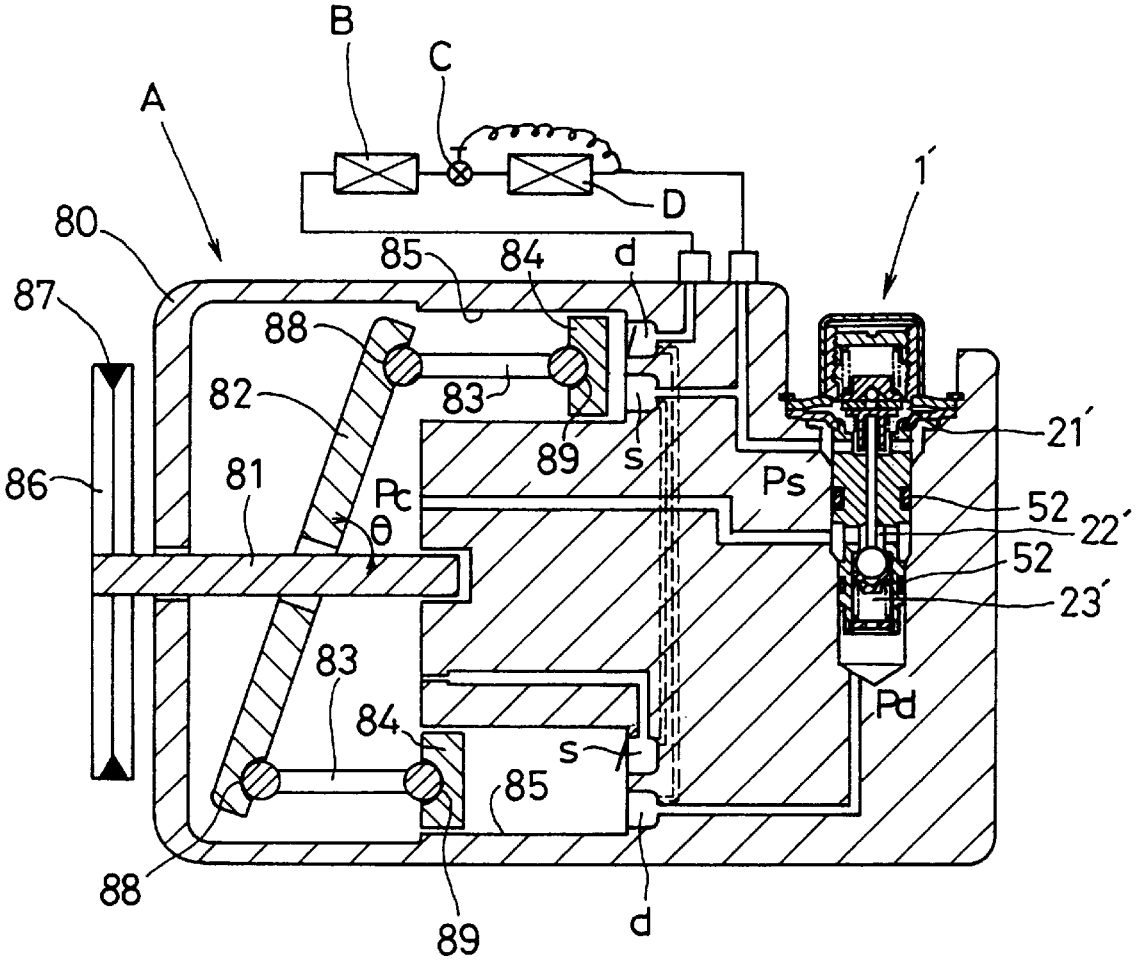
FIG. 7 is a cross-sectional view illustrating an entire structure of a vapor compression type refrigerating apparatus.
Figure 8:
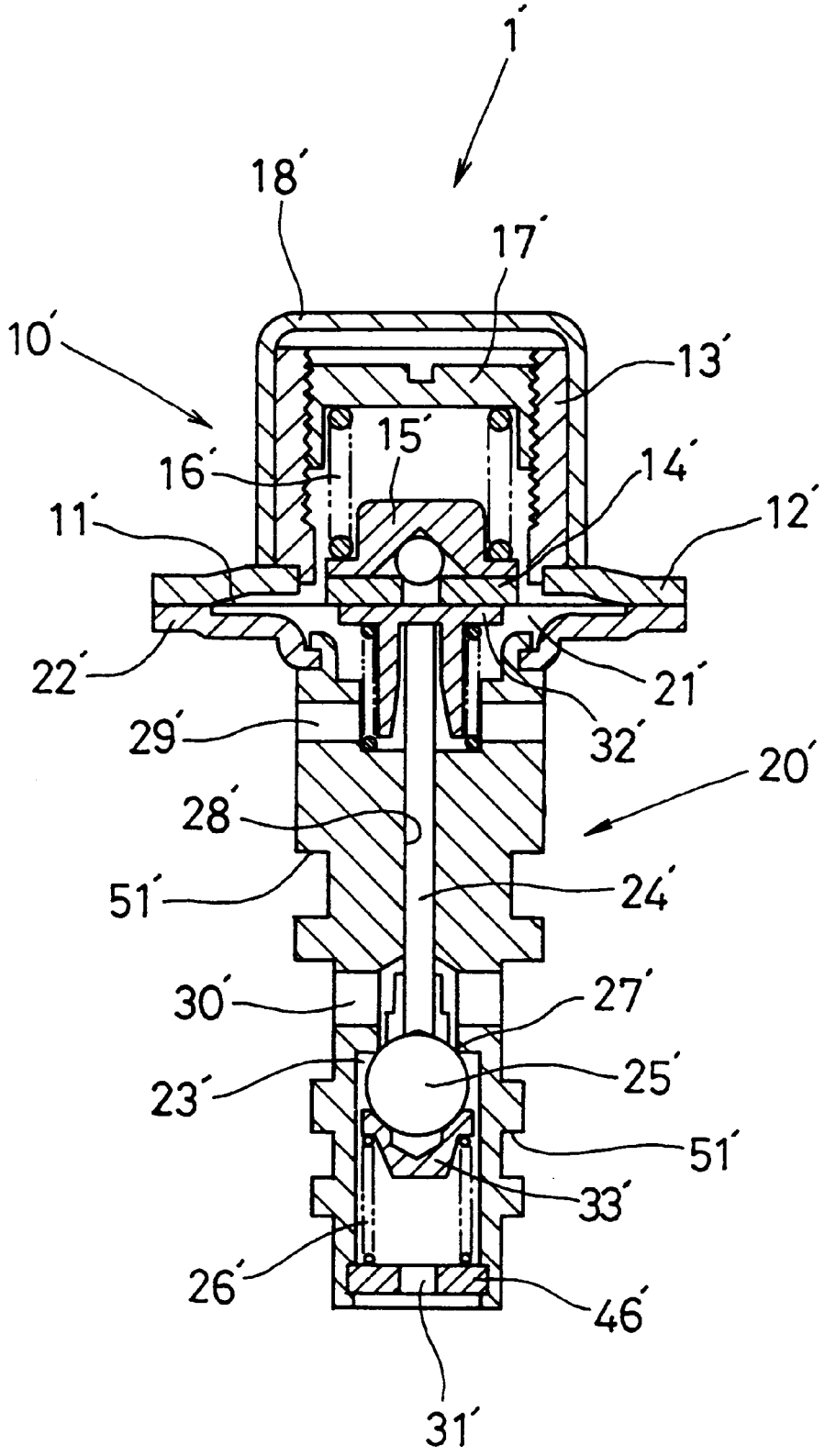
FIG. 8 is a longitudinal sectional view illustrating a conventional pressure adjusting valve.

By the way, as shown in FIGS. 7 and 8, since the air-tightness between the pressure adjusting valve 1' of the prior art and the compressor A is effected by rendering each pressure at the suction pressure-introducing inlet port 29', at the crankcase inner pressure feeding port 30' and at the discharge pressure inlet port 31' to become an air-tight structure individually, the groove 51' for an O-ring is respectively formed on an outer circumferential wall portion of the main body portion between the suction pressure-introducing inlet port 29' and the crankcase inner pressure feeding port 30', as well as between the crankcase inner pressure feeding port 30' and the discharge pressure inlet port 31', and after attaching the O-ring 52 to the grooves 51' in advance, the resultant pressure adjusting valve 1' is assembled with the compressor A.

Figure 5:
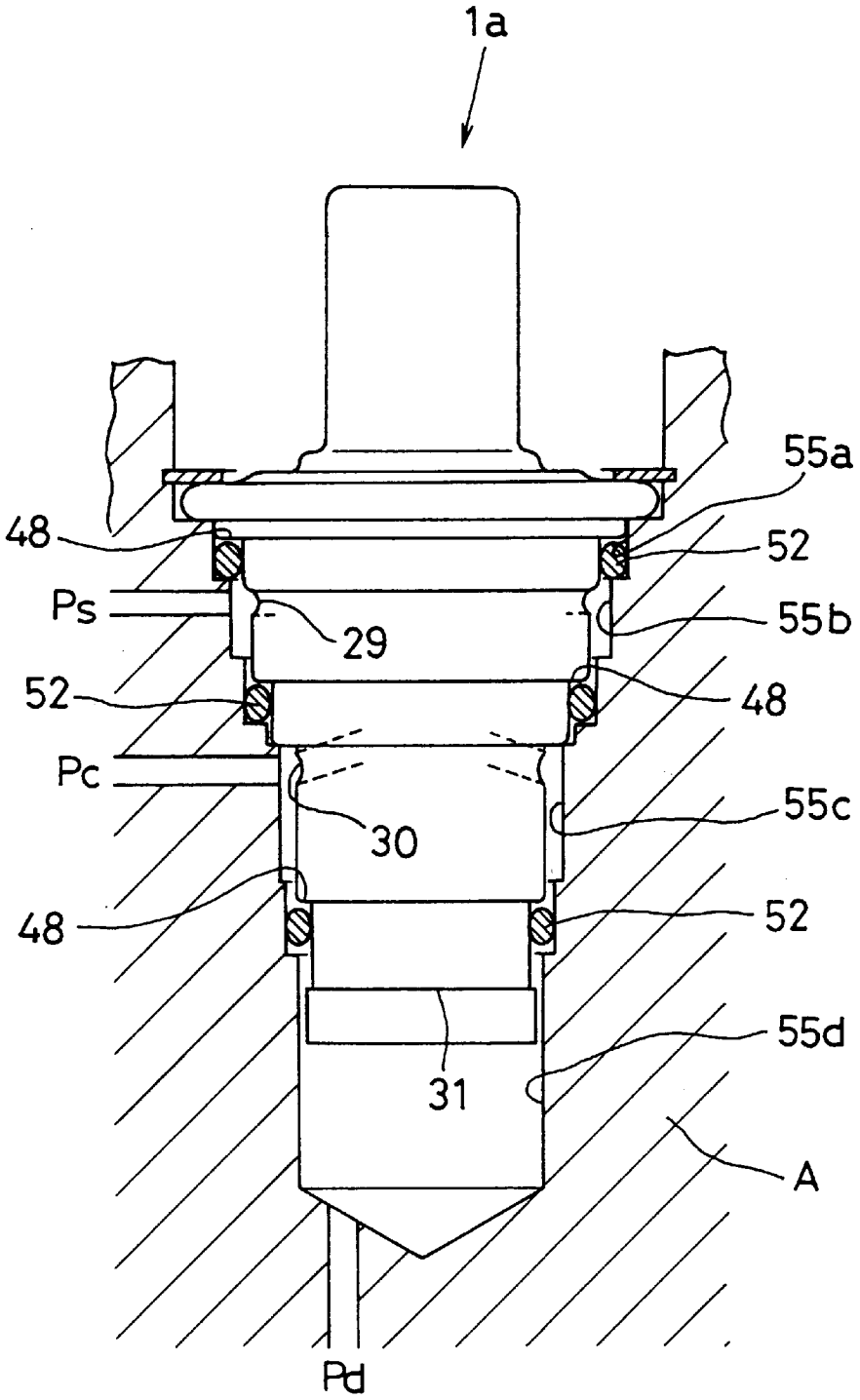
FIG. 5 is a cross-sectional view illustrating an assembling between a compressor and a pressure adjusting valve.

FIG. 5 shows an air-tight structure according to this embodiment, wherein the groove 51' for an O-ring is totally dispensed with in a pressure adjusting valve, and instead, the pressure adjusting valve 1*a* provided with stepped portions 48 which are gradually lowered in level in the direction from the suction pressure-introducing inlet port 29 to the discharge pressure inlet port 31 is assembled with the compressor A. The compressor A is provided on the inner circumferential wall thereof with the stepped portions 55*a* to 55*d* to be fitted with the configuration of the stepped portions 48 formed on the outer circumferential wall of the main body portion of the pressure adjusting valve 1*a*, and each pressure at the suction pressure-introducing inlet port 29, at the crankcase inner pressure feeding port 30 and at the discharge pressure inlet port 31 is separated from the others by attaching the O-ring 52 to each engaging portion, thereby realizing an air-tightness between the pressure adjusting valve 1*a* and the compressor A.

Figure 6:
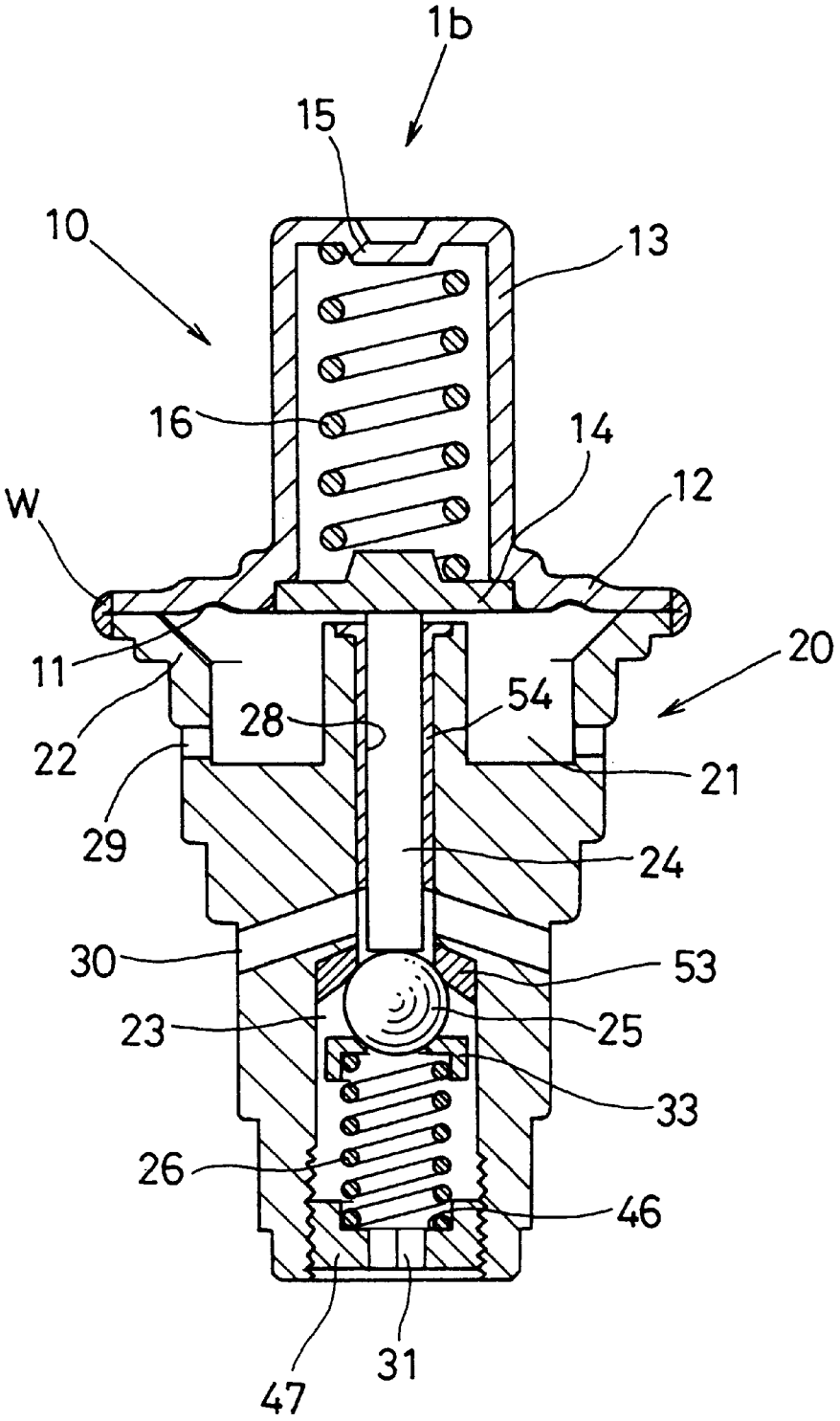
FIG. 6 is a longitudinal sectional view illustrating a pressure adjusting valve according to still another embodiment of the present invention.

FIG. 6 illustrates still another embodiment of the present invention, wherein this pressure adjusting valve 1*b* is constituted by a pressure responding motive portion 10 and a main body portion 20. The pressure responding motive portion 10 attached to the upper end of the main body portion 20 (made of copper) comprises an upper lid 12 (made of copper) retaining a diaphragm (made of beryllium copper) 11 which is sandwiched between the upper lid 12 and a lower lid 22 integrally attached to the main body portion 20, and a case 13 which is integrally mounted on the upper lid 12 or shell. Inside this case 13, a spring 16 is interposed between the upper end portion 15 of the spring case 13 and an upper reinforcing plate 14 of the diaphragm 11, the spring 16 urging a ball valve 25 in the direction to open the passageway.

The main body portion 20 comprises an operating rod 24 contacted with the diaphragm 11, and a slide hole 28 formed passing through the main body portion 20. A pressure chamber 21 is formed at a portion of the main body portion 20 where one end of the operating rod 24 is located, and is provided with an inlet port 29 for introducing a suction pressure. The other end of the operating rod 24 is extended to the valve chamber 23 in which there are disposed a ball valve 25 contacted with the other end of the operating rod 24, a valve seat 53 provided with a communicating hole for valve chamber 23, and a pressure-setting/ball valve-retaining spring 26 being interposed between the valve guard contacting with the ball valve 25 and the adjusting spring stopper 46 screwed into the valve chamber 23, and set so as to urge the ball valve 25 in the direction to close the passageway.

A feeding port 30 for feeding a pressure inside the crankcase is formed over the valve chamber 23, and an inlet port 31 for introducing a discharge pressure is formed below the valve chamber 23. The pressure adjusting valve 1*b* is designed to detect the suction pressure Ps and to control the pressure Pc inside the crankcase thereby to alter the magnitude of stroke of the piston 84, thus maintaining the pressure of the evaporator D.

Next, the connection between the pressure responding motive portion 10 and the main body portion 20 in the pressure controlling valve 1*b* will be explained. Namely, this connection is effected through a combination between the upper lid 12 of the pressure responding motive portion 10 and the lower lid 22 of the main body portion 20.

The upper lid 12 and lower lid 22 are both cylindrical in configuration being formed coaxial with the longitudinal axis of the slide hole 28 of the main body portion 20. These upper and lower lids 12 and 22 are formed by means of press molding or cutting. The spring case 13 formed integral with the upper lid 12 is assembled with a spring urging the ball valve 25 in the direction to open the passageway and with an upper reinforcing plate 14. Then, the operating rod 24 is fitted in the main body portion 20 integrally formed with the lower lid 22, after which the diaphragm 11 is held between the upper lid 12 and the lower lid 22. Thereafter, the brim portions W of the diaphragm 11, the upper lid 12 and the lower lid 22 are simultaneously welded by means of electron beam welding (EBW).

According to this pressure controlling valve 1*b*, the valve seat 53 and a collar 54 each formed of a material different from that of the main body portion 20 are disposed in the valve chamber 23 and the slide hole 28. Specifically, by making use of the valve seat 53 formed of a hard material (such as brass, SUS, etc.) as compared with that of the main body portion 20, the abrasion of the valve seat 53 can be minimized, and by fitting the collar 54 (such as brass, resin, etc.) in the slide hole 28, the movement of the operating rod 24 can be stabilized.

It is possible according to the embodiments of the present invention to obtain the following effects.

When the diaphragm 11 is sandwiched between the upper lid 12 and the lower lid 22, and after the fitting portion 33, the annular projection 34 and the diaphragm 11 are integrally caulked, the space S formed between the annular projection 34 and the upper lid 12 is sealed by making use of a solder as explained in the embodiment of FIG. 1, the air-tightness of the pressure responding motive portion 10 can be improved.

Further, when an electron beam welding is employed as illustrated in the embodiments of FIGS. 4 and 6, the pressure responding motive portion 10 can be always prevented from being influenced by any changes in air atmosphere and temperature, so that works such as the exhaustion or gas filling by making use of a capillary tube, the sealing of the capillary tube, etc. can be dispensed with, thus facilitating the manufacture and adjustment of the pressure adjusting valve as compared with the conventional pressure adjusting valve.

Further, when the end face of the small diametral side 35 of the ball valve-retaining spring 26 is flattened by means of polishing and then used to directly support the ball valve 25, the seating of the ball valve 25 can be stabilized, thus making it possible to omit the employment of special member such as a valve guard for supporting the ball valve 25. Furthermore, when the contacting portion between the ball valve-retaining spring 26 and the ball valve 25 is spot-welded to integrally connect the ball valve-retaining spring 26 and the ball valve 25, the separation of the ball valve 25 from the ball valve-retaining spring 26 can be prevented even if the ball valve 25 is suddenly opened or closed.

Since a tapered portion 37 tapering in the direction directed from the outside of the discharge pressure-introducing port 31 to the inner wall of the valve chamber 23, the mounting of the ball valve-retaining spring 26 can be facilitated, and the ball valve-retaining spring 26 can be prevented from falling out due to the stepped portion to be formed between the small diametral end portion of the tapered portion 37 and the inner wall of the valve chamber 23. As a result, a supporting member such as a spring shoe, or a caulking work for fixing the spring shoe can be dispensed with.

Since the compressor A is provided on the inner circumferential wall thereof with stepped portions fitting the shape of the stepped portion 48 formed on the outer circumferential wall of the pressure adjusting valve 1*a*, and the O-ring 52 is placed at the engaging portions of these stepped portions, it is possible to reduce the cost for manufacturing the pressure adjusting valve.

As explained above, since the pressure adjusting valve according to the present invention is designed such that the upper lid or the lower lid is closely sealed with the diaphragm by means of caulking and additional soldering, or by means of electron beam welding, the reliability in air-tightness of the pressure responding motive portion can be improved.

Moreover, since the working steps or parts to be employed can be reduced, it is possible to reduce the manufacturing cost of the pressure adjusting valve while making it possible to improve the performance of the pressure adjusting valve.

What is claimed is:

1. A pressure adjusting valve for a variable capacity compressor comprising a main body portion provided with a lower lid, a spring case provided with an upper lid, and a diaphragm held between said upper lid and said lower lid; and further comprising a hermetic seal formed by engagement of a caulked portion of an annular projection on said lower lid in engagement with said upper lid and by a body of solder received in a space between said annular projection and said upper lid.

2. A pressure adjusting valve for a variable capacity compressor comprising a main body portion provided with a lower lid, a spring case provided with an upper lid, and a diaphragm held between said upper lid and said lower lid; and further comprising said upper lid and said lower lid are hermetically connected with each other by means of an electron beam welding which is effected at annular outer circumferential portions of these upper and lower lids a hermetic seal formed by an electron beam weld between annular outer circumferential portions of said upper and lower lids.

3. The pressure adjusting valve for a variable capacity compressor according to claim 1 or 2, wherein said main body portion is provided with a valve chamber having a valve body arranged therein, and a conical coil spring urging said valve body in a direction to close a passageway, wherein said conical coil spring is arranged such that a smaller diametral portion thereof is directly contacted with said valve body thereby pushingly supporting said valve body.

4. The pressure adjusting valve for a variable capacity compressor according to claim 3, wherein a larger diametral portion of said conical coil spring is engaged with an annular step portion formed in said valve chamber.

5. The pressure adjusting valve for a variable capacity compressor according to claim 1 or 2, wherein said main body portion is provided with a valve chamber, and a valve body guide arranged in said valve chamber, wherein said valve body guide is provided with an outer circumferential side wall contacting with said valve chamber and an inner circumferential side wall with which said valve body is contacted, said inner circumferential side wall being provided with a large number of grooves extending in the direction of flow.

6. The pressure adjusting valve for a variable capacity compressor according to claim 3, wherein said main body portion is provided with an operating rod for actuating the valve body in an interlocking manner in relative to the movement of the diaphragm, and with a slide hole for allowing the operating rod to slidably move therein, wherein the operating rod and the slide hole are designed to be partially contacted with each other, thus forming a partial sliding surface therebetween.

7. The pressure adjusting valve for a variable capacity compressor according to claim 1 or 2, wherein said main body portion is provided on the outer circumferential wall thereof with a plurality of annular stepped portions which are diametrally reduced stepwise and are respectively fitted with an annular sealing member, the annular stepped portions being adapted to be engaged with a plurality of annular stepped portions which are diametrally reduced and formed on the inner wall of the engaging hole provided in the variable capacity compressor.

8. The pressure adjusting valve of claim 1, wherein said annular projections has a step portion formed on an inner side, and said outer circumferential end portion of said diaphragm is spaced from contact with said annular projection by said step portion.

9. The pressure adjusting valve of claim 1, wherein said annular projection has a length longer than the length of an outer circumferential end portion of said diaphragm.

10. The pressure adjusting valve of claim 2, wherein said upper lid and said lower lid are formed from a metal different from that forming said main body portion, and further comprising an electron beam weld formed between the outer circumferential portions of said upper and lower lids.

* * * * *